US008481874B2

(12) United States Patent
Takagi

(10) Patent No.: US 8,481,874 B2
(45) Date of Patent: Jul. 9, 2013

(54) KEY SWITCH STRUCTURE

(75) Inventor: Yasushi Takagi, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 330 days.

(21) Appl. No.: 13/061,979

(22) PCT Filed: Jun. 4, 2010

(86) PCT No.: PCT/JP2010/059561

§ 371 (c)(1),
(2), (4) Date: Mar. 3, 2011

(87) PCT Pub. No.: WO2010/150640

PCT Pub. Date: Dec. 29, 2010

(65) Prior Publication Data

US 2011/0162948 A1 Jul. 7, 2011

(30) Foreign Application Priority Data

Jun. 26, 2009 (JP) ..... 2009-152419

(51) Int. Cl.
*H01H 13/705* (2006.01)
*H01H 13/7057* (2006.01)
*H01H 13/7065* (2006.01)

(52) U.S. Cl.
USPC ..... 200/5 A; 200/517; 200/344

(58) Field of Classification Search
USPC ..... 200/5 A, 517, 341–345; 400/490–496
See application file for complete search history.

(56) References Cited

U.S. PATENT DOCUMENTS

| | | | | |
|---|---|---|---|---|
| 4,580,022 | A | 4/1986 | Oelsch et al. | |
| 5,625,532 | A * | 4/1997 | Sellers | 361/679.08 |
| 5,847,337 | A * | 12/1998 | Chen | 200/5 A |
| 5,901,837 | A * | 5/1999 | Aimi | 200/344 |
| 5,912,443 | A * | 6/1999 | Hasunuma | 200/5 A |
| 6,130,388 | A * | 10/2000 | Nishijima | 200/293 |
| 6,971,807 | B2 * | 12/2005 | Tsai et al. | 400/472 |
| 8,299,382 | B2 * | 10/2012 | Takemae et al. | 200/344 |

FOREIGN PATENT DOCUMENTS

| | | | |
|---|---|---|---|
| JP | 60-062017 | A | 4/1985 |
| JP | 10-241488 | A | 9/1998 |
| JP | 11-185564 | A | 7/1999 |
| JP | 2001-229764 | A | 8/2001 |
| JP | 2002-063826 | A | 2/2002 |
| JP | 2002-216576 | A | 8/2002 |

* cited by examiner

*Primary Examiner* — Michael Friedhofer
(74) *Attorney, Agent, or Firm* — Rabin & Berdo, P.C.

(57) ABSTRACT

Provided is a key switch structure wherein a membrane sheet (7) having a movable contact point (7*e*) and a stationary contact point (7*d*) is provided between a housing (5), which supports a key top (1) so as to allow the key top to be pushed downward and a base plate (8). The movable contact point (7*e*) is brought into contact with the stationary contact point (7*d*) by a downward push to the key top (1), so that a switch is closed. In the key switch structure, the inside of a device's main body is completely shielded from outside air, and water is completely prevented from entering the inside of the device's main body. A plate (6) provided with a plurality of attachment holes (6*g*) corresponding to fixing pins (5*f*) of the housing (5) is provided on the membrane sheet (7), so that the fixing pins (5*f*) are secured in the attachment holes (6*g*) of the plate (6).

2 Claims, 6 Drawing Sheets

KEY SWITCH STRUCTURE

TECHNICAL FIELD

The present invention relates to a key switch structure in a keyboard apparatus of a personal computer or the like.

RELATED ART

In recent years, mobile apparatuses (hereinafter, referred to as "apparatus bodies"), such as laptop PCs, have come to be able to be carried for hours due to long lasting battery, and thus, there is a demand for all-weather apparatuses. In order to meet this demand, a technique for realizing a drip-proof property or a water-proof property is necessary. For example, there has been an increasing demand for a technique capable of preventing rain water from seeping into the apparatus body through a keyboard, even when a user operates keys outdoors in rainy weather.

FIG. 4 is a sectional view illustrating a conventional key switch that takes in account of the foregoing. FIG. 5 is an exploded perspective view illustrating the conventional key switch.

As shown in the drawings, a conventional key switch includes a key top 21, a first link member 22, a second link member 23, an elastic member 24, a housing 25, a membrane sheet 26, and a base plate 27.

On the key top 21, there are provided rotation support portions 21*a* and 21*b* that support one end of the first link member 22 to be rotatable, and slide support portions 21*c* and 21*d* that support one end of the second link member 23 to be rotatable and parallely movable in horizontal direction.

The first link member 22 has a pair of leg portions 22*a* and 22*b*. A first connection rod 22*c* is disposed at one end of the leg portions 22*a* and 22*b* to connect the leg portions 22*a* and 22*b* with each other. The first connection rod 22*c* is inserted into the rotation support portions 21*a* and 21*b* of the key top 21, and is supported thereby. Likewise, a second connection rod 22*d* is disposed at the other end of the leg portions 22*a* and 22*b* to connect the leg portions 22*a* and 22*b* with each other. Shafts 22*e* and 22*f* are provided on the outside surface of the leg portions 22*a* and 22*b*, respectively, at positions on a line that connects the first connection rod 22*c* and the second connection rod 22*d*. The shafts 22*e* and 22*f* are disposed at the middle position between the connection rods 22*c* and 22*d*, respectively.

The second link member 23 has a pair of leg portions 23*a* and 23*b*. First support protrusions 23*c* and 23*d* are provided outward at one end of the leg portions 23*a* and 23*b*, respectively. The first support protrusions 23*c* and 23*d* are supported by the slide support portions 21*c* and 21*d* of the key top 21, to be rotatable and parallely movable in horizontal direction. Second support protrusions 23*e* and 23*f* are provided inward at the other end of the second link member 23. The second support protrusions 23*e* and 23*f* are disposed so that the distance between the first support protrusions 23*c* and 23*d*, and the second support protrusions 23*e* and 23*f*, is the same as the distance between the connection rods 22*c* and 22*d* of the first link member 22.

Shaft holes 23*g* and 23*h* are provided at the leg portions 23*a* and 23*b*, respectively, at positions on a line that connects the first support protrusions 23*c* and 23*d* and the second support protrusions 23*e* and 23*f*. The shaft holes 23*g* and 23*h* are disposed at the middle position of the support protrusions 23*c* and 23*e*, and the middle position of the support protrusions 23*d* and 23*f*, respectively. The leg portions 23*a* and 23*b* are connected with each other by a connection portion 23*i* on the front side of the first support protrusions 23*c* and 23*d*.

The elastic member 24 made of rubber or the like, is formed in substantially a cup shape, and is formed including a contact point depression portion 24*a* in the inner middle part thereof. The housing 25 formed in a frame shape and separates each a key unit. Near one end of the housing 25, a side guide 25*a* is provided to support the second connection rod 22*d* of the first link member 22 to be rotatable and parallely movable in horizontal direction. Near the other end of the housing 25, rotation guides 25*c* and 25*d* are provided to rotatably support the second support protrusions 23*e* and 23*f* of the second link member 23.

In the middle of both end sides of the housing 25, arc shaped guide walls 25*e* that fixes the outer peripheral portion of the elastic member 24 are provided, respectively, so as to face each other. Further, on the lower surface of the housing 25, fixing pins 25*f* with a predetermined length are provided at plural positions so as to surround a through hole 26*f* of the membrane sheet 26.

The membrane sheet 26 includes two flexible sheets 26*a* and 26*b*, and a spacer sheet 26*c* interposed between the two flexible sheets 26*a* and 26*b*. Plural through holes 26*f* are provided in the spacer sheet 26*c* so as to correspond to plural keys.

The through hole 26*f* forms a space between the two flexible sheets 26*a* and 26*b*. A fixed contact point 26*d* is disposed in the flexible sheet 26*b* closer to the base plate 27, and a movable contact point 26*e* is disposed in the flexible sheet 26*a* closer to the elastic member 24.

The fixed contact point 26*d* and the movable contact point 26*e* are disposed to face each other in the space. Further, plural perforated holes 26*g* are provided in the membrane sheet 26 so as to be located around the through hole 26*f*.

The base plate 27 is disposed at a lower portion to mount the above-mentioned members (the key top 21, the first link member 22, the second link member 23, the elastic member 24, the housing 25, and the membrane sheet 26). Spacer protrusions 27*a* having the same thickness as that of the membrane sheet 26 are formed in the base plate 27, so as to correspond to the perforated holes 26*g* of the membrane sheet 26. A fitting hole 27*b* that passes through therein the fixing pin 25*f* of the housing 25, is provided to penetrate in the middle of the spacer protrusion 27*a*. Further, on the lower surface of the base plate 27, a concave portion (counterbore portion) 27*c* is formed around the fitting hole 27*b*.

The members having the above-described configuration are assembled as follows. Namely, the shafts 22*e* and 22*f* of the first link member 22 are fitted into the shaft holes 23*g* and 23*h* of the second link member 23, so that the first link member 22 and the second link member 23 rotatably couple with each other in an X shape. The first connection rod 22*c* of the first link member 22 is inserted into the rotation support portions 21*a* and 21*b* of the key top 21. Further, the first support protrusions 23*c* and 23*d* of the second link member 23 are inserted into the slide support portions 21*c* and 21*d* of the key top 21 to be rotatable and parallely movable in horizontal direction.

On the other hand, the membrane sheet 26 is mounted on the base plate 27 so that the spacer protrusions 27*a* of the base plate 27 are inserted into the perforated holes 26*g* of the membrane sheet 26, and the fixing pins 25*f* of the housing 25 are pressed from the upper side to be inserted into the fitting holes 27*b* of the spacer protrusions 27*a*. Further, the housing 25 is fixed onto the base plate 27 together with the membrane sheet 26 by heating and deforming the front ends of the fixing pins 25*f* protruding toward the lower surface of the base plate 27 in a flat shape. Thus, the deformed portion 25*g* of the fixing pin 25*f* is fitted into the concave portion 27*c* of the base plate 27, and is welded to the concave portion 27*c* to cover the fitting hole 27*b*.

The lower portion of the elastic member 24 is engaged with the inside of the guide walls 25*e* to be fixed onto the membrane sheet 26. While putting the key top 21 on the elastic member 24 from the upper side, the second connection rod 22*d* of the first link member 22 is inserted into the slide guide 25*a* of the housing 25, and the second support protrusions 23*e* and 23*f* of the second link member 23 are inserted into the rotation guides 25*c* and 25*d* of the housing 25, respectively.

FIGS. 6A and 6B are sectional views illustrating the operation of the above-described conventional key switch. Note that, in these figures, the fitting holes 27*b* and the concave portions 27*c* of the base plate 27 and the fixing pins 25*f* of the housing 25 are not illustrated to the simplify the drawings.

First, when the key tip 21 is pressed down with a finger or the like and is moved downward, the first link member 22 rotates clockwise about the first connection rod 22*c*, rotatably supported by the rotation support portions 21*a* and 21*b* of the key top 21. The second connection rod 22*d* disposed on the other end of the first link member 22 slides horizontally along the slide guide 25*a* of the housing 25.

The shafts 22*e* and 22*f* of the first link member 22 rotatably fit into the shaft holes 23*g* and 23*h*. With such a configuration, the first support protrusions 23*c* and 23*d* of the second link member 23 slide horizontally along the slide support portions 21*c* and 21*d* of the key top 21, when the first link member 22 moves. Moreover, the second link member 23 rotates counterclockwise about the second support protrusions 23*e* and 23*f*, rotatably supported by the rotation guides 25*c* and 25*d* of the housing 25.

Accordingly, the key top 21 moves downward while maintaining to be parallel to the housing 25. Due to the downward movement of the key top 21, the back surface of the key top 21 presses the upper portion of the elastic member 24, and the elastic member 24 is compressed and deformed. Then, the contact point depression portion 24*a*, formed inside the elastic member 24 and are protruding downward, comes into contact with the flexible sheet 26*a* of the membrane sheet 26 to press the flexible sheet 26*a*.

Thus, as shown in FIG. 6A, the movable contact point 26*e* comes into contact with the fixed contact point 26*d* to be electrically connected, and thus, the switch enters a closed state. Moreover, when the key top 21 is pressed down, the first link member 22 and the second link member 23 rotate up to the position horizontal with the housing 25 without overlapping, since the connection portion 23*i* of the second link member 23 is disposed on the further end side of the first support protrusions 23*c* and 23*d*.

When the pressed state of the key top 21 is released, each of the constituent members return to the original positions due to the restoring force of the elastic member 24, as shown in FIG. 6B, and the movable contact point 26*e* of the membrane sheet 26 moves apart from the fixed contact point 26*d*. Thus, since the electric connection is disconnected, the switch enters an opened state.

As described above, in the conventional key switch, the housing 25 is fixed onto the base plate 27 together with the membrane sheet 26 by heating and deforming the front ends of the fixing pins 25*f* to a flat shape, as shown in FIG. 4. Thus, the deformed portion 25*g* of the fixing pin 25*f* engages with the concave portion 27*c* of the base plate 27, the deformed portion 25*g* is welded to the concave portion 27*c*, and thus the fitting hole 27*b* is covered, thereby realizing the drip-proof property. For example, see the following document. Patent Document 1: Japanese Patent Application Laid-Open (JP-A) No. 2001-229764

DISCLOSURE OF THE INVENTION

Problem to be Solved by the Invention

However, in the conventional key switch, as described above, it is difficult to completely block all the fixing holes of the fixing pins, since the plural holes for disposing the fixing pins of the housing is provided in the membrane sheet and the base plate.

In order to block the outside air, to realize the drip-proof property and further to realize the water-proof property, it is necessary to block the gap between the fixing pin and the perforated hole of the membrane. However, although when an adhesive or the like is applied to the gap, the gap may not be completely blocked due to the influence of clearance with the members of the key switch. Accordingly, complete water-proof property may not be realized, although temporarily water-proof property has been realized.

Method of Solving the Problem

The present invention adopts configuration to resolve the above-mentioned problem. Namely, in a key switch structure in which a membrane sheet having contact points facing each other is interposed between a base plate and a housing that allowably supports a key top to be pressed down and has fixing pins, and that closes a switch by contacting the contact points when the key top is pressed down, the key switch structure is structured to include, a plate, disposed on the membrane sheet, that includes a plurality of fitting holes that corresponds to the fixing pins, and is structured so that the fixing pins are fixed at the fitting holes of the plate.

Effect of the Invention

In a key switch structure of the present invention, in which a membrane sheet having contact points facing each other is interposed between a base plate and a housing that allowably supports a key top to be pressed down and has fixing pins, and that closes a switch by contacting the contact points when the key top is pressed down, the key switch structure is structured to include the plate disposed on the membrane sheet and has the plural fitting holes corresponding to the fixing pins, and is structured so that the fixing pins are fixed at the fitting holes of the plate. Therefore, the complete drip-proof property may be realized since the apparatus body may be completely blocked from the outside air.

BEST MODE OF IMPLEMENTING THE INVENTION

Figure 1:
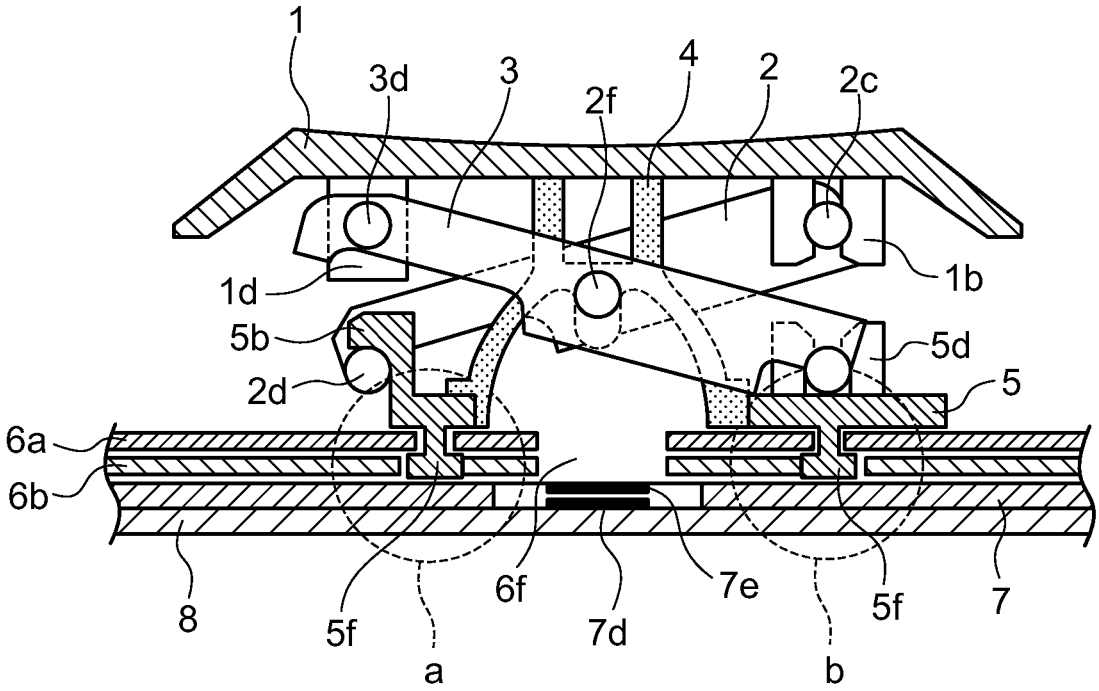
FIG. 1 is a sectional view illustrating a key switch according to an embodiment.

Hereinafter, an embodiment of the present invention will be described with reference to the drawings. The same reference numerals are given to the same constituent elements in the drawings.

[Embodiment]

(Configuration)

Figure 2:
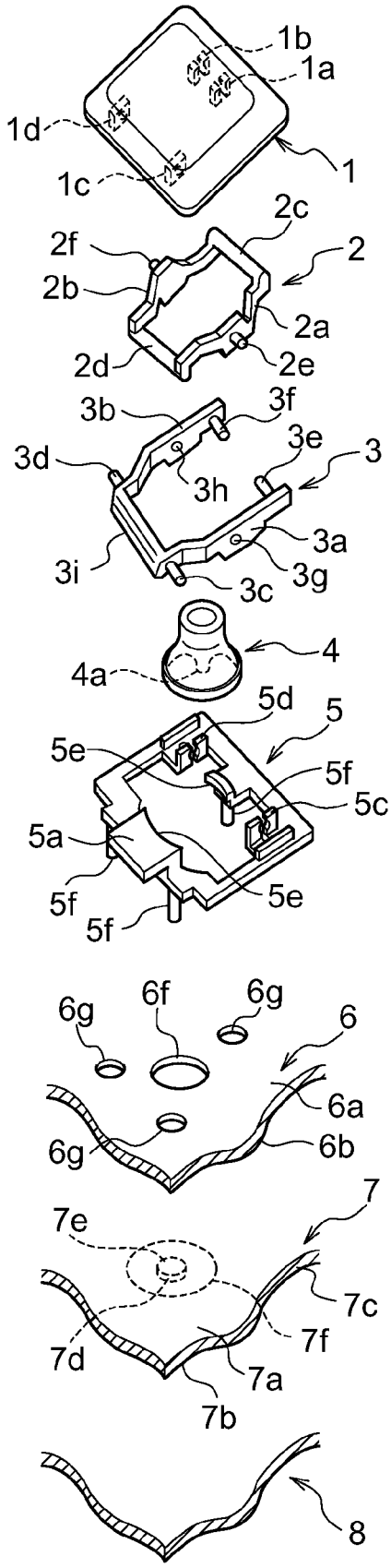
FIG. 2 is an exploded perspective view illustrating the key switch according to the embodiment.

FIG. 1 is a sectional view illustrating a key switch and FIG. 2 is an exploded perspective view illustrating the key switch according to the first embodiment.

The key switch is structured by a key top 1, a first link member 2, a second link member 3, an elastic member 4, a housing 5, a plate 6, a membrane sheet 7, and a base plate 8. The plate 6 is structured by an upper plate 6*a* and a lower plate 6*b*.

Rotation support portions 1*a* and 1*b*, and slide support portions 1*c* and 1*d* are provided on the key top 1. The first link member 2 has a pair of leg portions 2*a* and 2*b*. A first connection rod 2*c* is disposed at one end of the leg portions 2*a* and 2*b*, and a second connection rod 2*d* is disposed at the other end of the leg portions 2*a* and 2*b*. Further, rotation shafts 2*e* and 2*f* are provided at leg portions 2*a* and 2*b*, respectively. The rotation shafts 2*e* and 2*f* are structured by two kinds of columns including a diameter, from the middle to the front end, smaller than a diameter from the root to the middle of the shaft.

The second link member 3 has a pair of leg portions 3*a* and 3*b* connected to each other by the connection portion 3*i*. First support protrusions 3*c* and 3*d* are provided at one end of the leg portions 3*a* and 3*b*, respectively. Second support protrusions 3*e* and 3*f* are provided at the other end of the leg portions 3*a* and 3*b*, respectively. Further, shaft holes 3*g* and 3*h* are provided at the leg portions 3*a* and 3*b*, respectively. The shaft holes 3*g* and 3*h* are structured by two kinds of holes having a diameter, from the middle to the front end, smaller than a diameter, from the root to the middle of the hole.

The first link member 2 and the second link member 3 rotatably engage with each other so that the rotation shafts 2*e* and 2*f* are fitted into the shaft holes 3*g* and 3*h*.

The elastic member 4 formed of rubber or the like is formed in a reverse cup shape. A contact point depression portion 4*a* protrudes at the middle of the inner surface of the elastic member 4. The elastic member 4 is disposed on the membrane sheet 7 so that the top of the elastic member 4 comes into contact with the rear surface of the key top 1.

Slide guides 5*a* and 5*b*, rotation guides 5*c* and 5*d*, and guide walls 5*e* fixing the elastic member 4 are provided in the housing 5. Moreover, fixing pins 5*f* that passes through the plate 6 and having its front end being thermally caulked, are provided in the housing 5.

The above-described members (the key top 1, the first link member 2, the second link member 3, the elastic member 4, the housing 5, and the plate 6) are mounted on the membrane sheet 7. Fitting holes 6*g* are provided in the upper plate 6*a* and the lower plate 6*b* of the plate 6, as shown in "a" and "b" of FIG. 1. The fitting holes 6*g* are provided to form concave portions for fixing the front ends of the fixing pins 5*f* of the housing 5 to be thermally caulked. As shown in FIG. 1, the fitting hole 6*g* has a smaller diameter on the side of the upper plate 6*a* compared to the side of the lower plate 6*b*, so that the front ends of the fixing pins 5*f* can be fixed by thermal caulk. A through hole 6*f* is provided in the upper plate 6*a* and the lower plate 6*b*, so that the contact point depression portion 4*a* of the elastic member 4 passes through the through hole 6*f*.

The membrane sheet 7 includes an upper sheet 7*a* having a movable contact point 7*d*, a lower sheet 7*b* having a fixed contact point 7*e*, and a spacer sheet 7*c* interposed between the upper sheet 7*a* and the lower sheet 7*b*. Plural through holes 7*f* are provided at the spacer sheet 7*c*.

The plural through holes 7*f* are provided at the spacer sheet 7*c*, however, the through holes 7*f* are covered with the upper sheet 7*a* and the lower sheet 7*b* so as to be completely blocked from the outside air. Therefore, the membrane sheet 7 and the plate 6 may be fixed to each other just by attaching an adhesive, such as a double-sided tape. Alternatively, the membrane sheet 7 and the plate 6 may be superimposed at the fitting hole of the keyboard apparatus, when the membrane sheet 7 and the plate 6 are not attached to each other.

The base plate 8 is disposed lower to maintain the strength of the contact portion of the membrane sheet. The base plate 8 and the membrane sheet 7 may be fixed by a double-sided tape, or may be mounted in the fixing holes of the keyboard apparatus, similarly to the fixing of the membrane sheet 7 and the plate 6.

In the above-described structure, the members are assembled as follows. Namely, the rotation shafts 2*e* and 2*f* of the first link member 2 are fitted into the shaft holes 3*g* and 3*h* of the second link member 3, so that the first link member 2 and the second link member 3 are rotatably couple with each other in an X shape. The first connection rod 2*c* of the first link member 2 is inserted into the rotation support portions 1*a* and 1*b* of the key top 1. Further, the first support protrusions 3*c* and 3*d* of the second link member 3 are inserted into the slide support portions 1*c* and 1*d* of the key top 1, to be rotatable and parallely movable in horizontal direction.

Then, the housing 5 is fixed onto the plate 6 in such a manner that the fixing pins 5*f* of the housing 5 are inserted into the fitting holes 6*g* of the plate 6 from the upper side, and the front ends of the fixing pins 5*f* protruding toward the lower surface of the plate 6 are deformed in a flat shape by heating or the like, as shown in FIG. 1.

Further, the membrane sheet 7 is fixed to the lower side of the plate 6 by an adhesive such as a double-sided tape. Likewise, the base plate 8 is fixed to the lower side of the membrane sheet 7 by an adhesive such as a double-sided tape.

(Operation)

Figure 3:
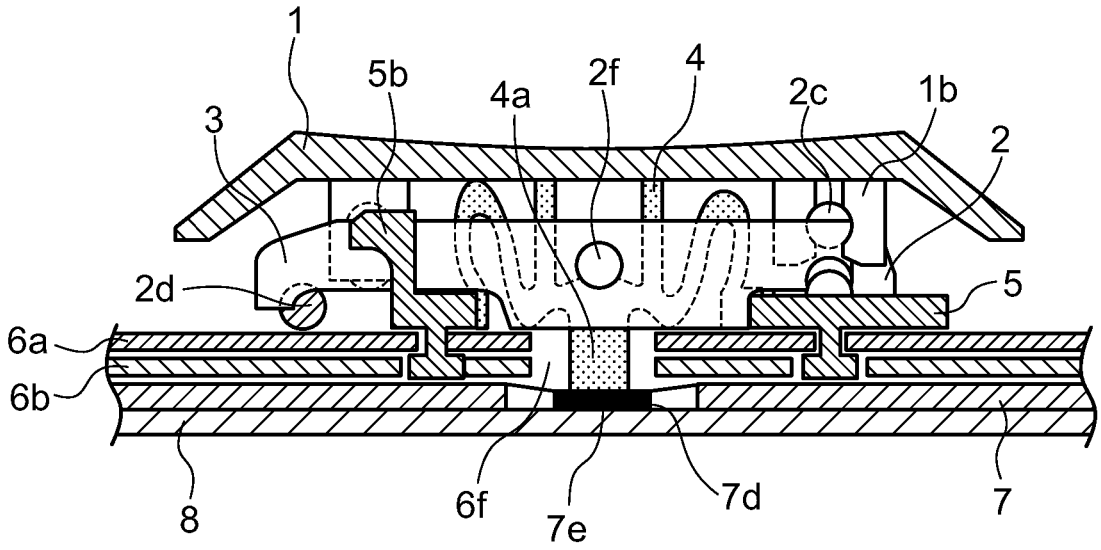
FIG. 3 is a diagram illustrating a pressed key switch according to the embodiment.
Figure 4:
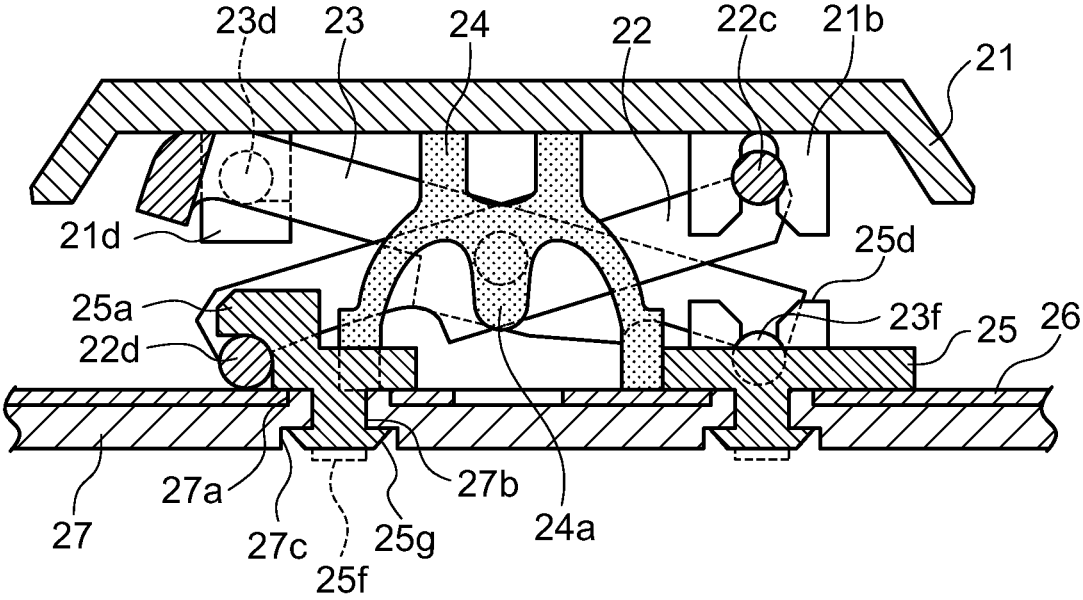
FIG. 4 is a sectional view illustrating a conventional key switch.
Figure 5:
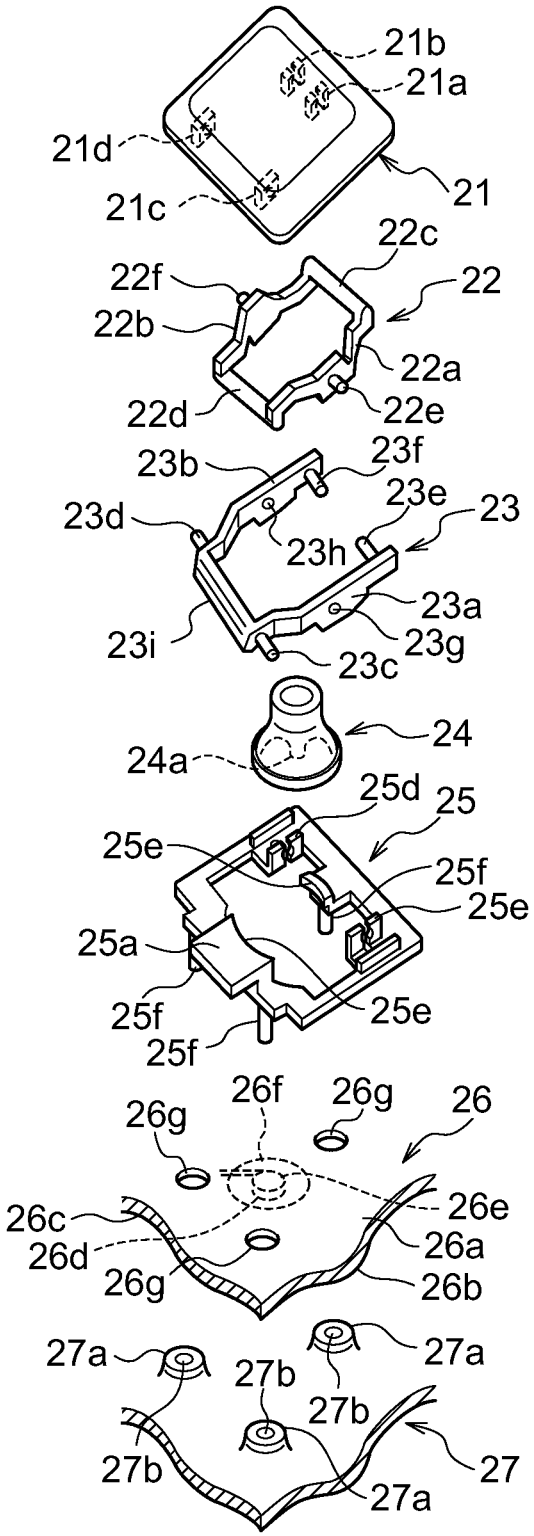
FIG. 5 is an exploded perspective view illustrating the conventional key switch.
Figure 6A:
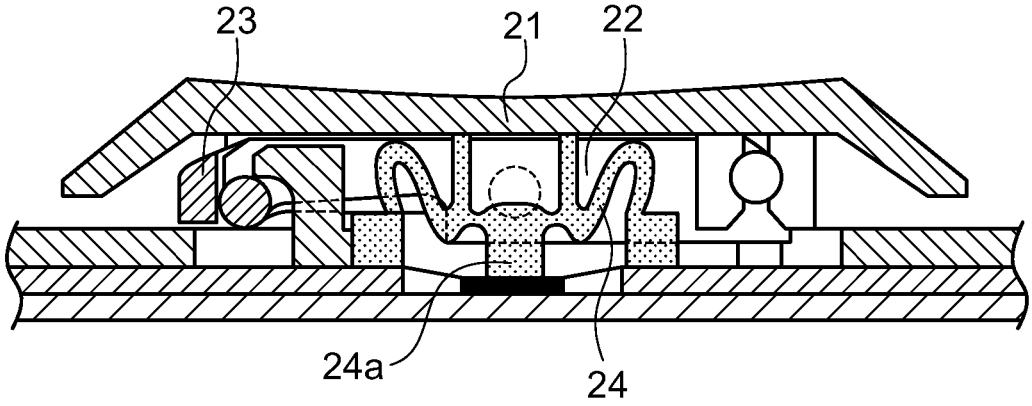
FIG. 6A is a sectional view illustrating the operation of the conventional key switch.
Figure 6B:
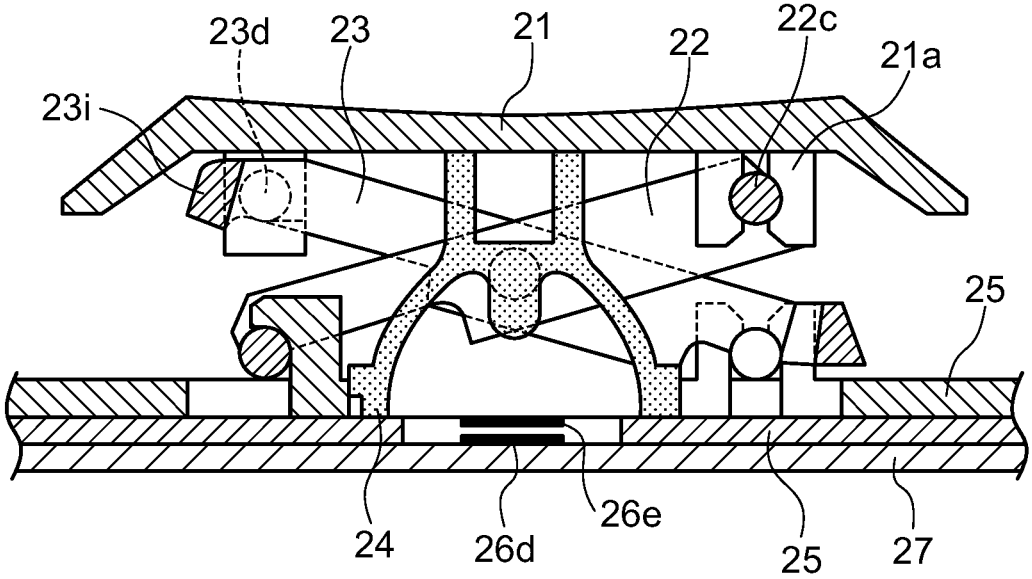
FIG. 6B is a sectional view illustrating the operation of the conventional key switch.

The key switch having the above-described structure according to the first embodiment operates as follows. Hereinafter, the operation of the key switch according to the first embodiment will be described with reference to FIG. 1 which is a sectional view showing a normal state, and FIG. 3 which is a sectional view showing a pressed state.

First, when the key tip 1 is pressed down with a finger or the like and is moved downward, the first link member 2 rotates clockwise about the first connection rod 2*c* rotatably supported by the rotation support portions 1*a* and 1*b* of the key top 1. The second connection rod 2*d* disposed on the other end of the first link member 2 slides horizontally along the slide guides 5*a* and 5*b* of the housing 5.

The rotation shafts 2*e* and 2*f* of the first link member 2 are rotatably fitted into the shaft holes 3*g* and 3*h*. Due thereto, the first support protrusions 3*c* and 3*d* of the second link member 3 slide horizontally along the slide support portions 1*c* and 1*d* of the key top 1, when the first link member 2 moves. Moreover, the second link member 3 rotates counterclockwise about the second protrusions 3*e* and 3*f*, rotatably supported by the rotation guides 5*c* and 5*d* of the housing 5.

Accordingly, the key top 1 moves downward while maintaining parallel to the housing 5. Due to the downward movement of the key top 1, the back surface of the key top 1 presses the upper portion of the elastic member 4, and the elastic member 4 is compressed and deformed. Further, the contact point depression portion 4*a* formed protruding downward inside the elastic member 4 comes into contact and presses the upper sheet 7*a* of the membrane sheet 7, through the through holes 6*f* of the upper plate 6*a* and the lower plate 6*b*.

Thus, the movable contact point 7*e* contacts and electrically connected with the fixed contact point 7*d*, and the switch enters a closed state. Moreover, when the key top 1 is pressed down, the first link member 2 and the second link member 3 rotates to the position at which is horizontal with the housing 5 without overlapping, since the connection portion 3*i* of the second link member 3 is disposed on the further end side of the first support protrusions 3*c* and 3*d*.

When the pressed state of the key top 1 is released, the constituent members return to the original positions due to the restoring force of the elastic member 4, as shown in FIG. 1, and the movable contact point 7*e* of the membrane sheet 7 moves apart from the fixed contact point 7*d*. Thus, since the electric connection is disconnected, the switch enters an opened state. At this time, since the each housing 5 is fixed to the plate 6 at the plural positions by the plural fixing pins 5*f*, the housing 5 does not float from the plate 6.

The housing 5 is fixed to the plate 6 by heating and deforming the front ends of the fixing pins 5*f* of the housing 5 to flat shape, and the membrane sheet 7 and the base plate 8 with no holes are attached from the bottom side of the plate 6. Accordingly, the apparatus body may be formed thin. Moreover, since the fitting holes 6*g* of the plate 6 may be completely blocked, the complete drip-proof property may be realized.

(Effects of Embodiment)

As described above in detail, in the key switch according to the first embodiment, in which a membrane sheet having contact points facing each other is interposed between a base plate and a housing that allowably supports a key top to be pressed down and has fixing pins, and that closes a switch by contacting the contact points when the key top is pressed down, the key switch structure is structured to include the plate disposed on the membrane sheet and has the plural fitting holes corresponding to the fixing pins, and is structured so that the fixing pins are fixed at the fitting holes of the plate. Therefore, the complete drip-proof property may be realized since the apparatus body may be completely blocked from the outside air.

(Other Modified Examples)

In the above-described embodiment, the plate 6 is divided into two plates, namely, the upper plate 6*a* and the lower plate 6*b*, and the holes with the different diameters are provided in order to form the concave portions for mounting the fixing pins 5*f* of the housing 5, as shown in the sectional view of FIG. 1. However, the concave portions with the same shape may be formed at one plate. On the other hand, the plate may be divided into three or more plates and the concave portions with the same shape may be formed.

In the above-described embodiment, the plate 6 is provided with the through holes 6*f* through which the contact point depression portion 4*a* of the elastic member 4 passes. However, the through hole 6*f* may not be provided, and the movable contact point 7*e* of the membrane sheet 7 may be brought into contact with the fixed contact point 7*d* by allowing the contact point depression portion 4*a* to press the movable contact point 7*e* with the upper plate 6*a* and the lower plate 6*b* interposed therebetween.

Industrial Applicability

As described above, the invention is widely applicable to keyboard apparatuses mounted on mobile apparatuses such as laptop PCs.

The invention claimed is:

1. A key switch structure in which a membrane sheet having contact points facing each other is interposed between a base plate and a housing that allowably supports a key top to be pressed down and has fixing pins, and that closes a switch by contacting the contact points when the key top is pressed down, the key switch structure comprising:

a plate, disposed on the membrane sheet, that includes a plurality of fitting holes that corresponds to the fixing pins, wherein the fixing pins are fixed at the fitting holes of the plate.

2. The key switch structure of claim 1, wherein the housing is formed for each key switch structure of a plurality of the key switch structures.

* * * * *